United States Patent [19]

Ross

[11] Patent Number: 5,035,417

[45] **Date of Patent: * Jul. 30, 1991**

[54] EXERCISE BICYCLE

[76] Inventor: Sherwood B. Ross, 197-07 Turnberry Way, No., Miami, Fla. 33108

[ * ] Notice: The portion of the term of this patent subsequent to Apr. 14, 2004 has been disclaimed.

[21] Appl. No.: 372,892

[22] Filed: Jun. 28, 1989

Related U.S. Application Data

[63] Continuation of Ser. No. 37,642, Apr. 13, 1987, which is a continuation-in-part of Ser. No. 892,788, Jul. 31, 1986, Pat. No. 4,657,244.

[51] Int. Cl.[5] ..... A63B 21/00

[52] U.S. Cl. ..... 272/73; 74/48

[58] Field of Search ..... 272/73, 71, 130, 97, 272/72, 132

[56] References Cited

U.S. PATENT DOCUMENTS

| | | | |
|---|---|---|---|
| 326,247 | 9/1885 | Root | 272/71 |
| 3,572,700 | 3/1971 | Mastropaolo | 272/132 |
| 4,188,030 | 2/1980 | Hooper | 272/73 |
| 4,657,244 | 4/1987 | Ross | 272/73 |
| 4,705,269 | 11/1987 | DeBoer et al. | 272/73 |

FOREIGN PATENT DOCUMENTS

| | | | |
|---|---|---|---|
| 0517774 | 1/1931 | Fed. Rep. of Germany | 272/73 |
| 1070769 | 8/1954 | France | 128/25 R |

*Primary Examiner*—Stephen R. Crow

*Attorney, Agent, or Firm*—Harness, Dickey & Pierce

[57] ABSTRACT

The invention includes a conventional exercise bicycle with foot pedals, a chain drive system and a flywheel. Rotating with the flywheel is a first gear which is in mesh with a second larger gear. Located on the face of the second gear, but offset from the center of the gear, is an eccentric which supports reciprocating arms. Movement of the reciprocating arms by the exerciser causes rotation of the second and first gears and, consequently, the flywheel.

6 Claims, 4 Drawing Sheets

EXERCISE BICYCLE

This is a continuation of U.S. patent application Ser. No. 37,642, filed Apr. 13, 1987, which is a continuation-in-part of application Ser. No. 892,788, filed July 31, 1986, now U.S. Pat. No. 4,657,244.

BACKGROUND OF THE INVENTION

This invention relates to an improved type of exercise bicycle, which is capable of providing exercise for not only the muscles of the leg, but also muscle groups in the upper part of the body. Most exercise bicycles simulate bicycles and provide exercise for only the muscles of the legs and the lower torso. Activities such as jogging and running, however, may be considered to be more beneficial than cycling, because they involve more muscle groups and place a greater cumulative demand on the aerobic system of the body.

Accordingly, in recent years there has been a need for a bicycle type exerciser which operates as a conventional exercise bicycle, but is also capable of providing exercise for muscle groups in the upper part of the body.

One particular cycle exerciser that has been marketed in recent years by Schwinn is protected by Hooper (U.S. Pat. No. 4,188,030). In the Hooper cycle exerciser, in addition to the conventional pedals 18 and 20, the cycle exerciser also includes elongated levers 28 with handgrips 32. The elongated levers 28 can pivot about the wheel axle 15, and the person using the bicycle can thus obtain exercise of the muscles in the upper part of the body. These elongated levers 28 are connected by means of drive bars 34 to the crank ring 35 which causes rotation of the energy-absorbing wheel 5.

This invention affords another type of exercise bicycle which can provide exercise for both the lower and upper part of the body, but which uses a different system for mounting the arm levers.

SUMMARY OF THE INVENTION

The exercise bicycle of this invention is constructed in the manner of a conventional exercise bicycle with foot pedals, a chain drive system and a front wheel. A pair of reciprocating arms are mounted on the frame for back and forth movement by the user, in order to provide exercise for the upper part of the body. Each of the reciprocating arms is associated with an eccentric which is mounted on the face of a gear or sprocket. As the reciprocating arms are moved back and forth, by means of the eccentric, the gear or sprocket is rotated. In one embodiment of the invention, the gear on which the eccentric is positioned is in mesh with a first gear that is on the axle of the front wheel and which rotates with the front wheel. This permits rotation of the front wheel, by means of the gears, when the reciprocating arms are moved back and forth. In a second embodiment of the invention, the sprocket on which the eccentric is located is connected by means of a system of chains and sprocket wheels to the front wheel. Thus, when the reciprocating arms are moved back and forth, by means of the eccentric, the sprocket and the chain and sprocket wheel system, the front wheel is caused to rotate. As a result, this exercise bicycle provides exercise for the upper part of the body, as well as the lower part of the body.

DETAILED DESCRIPTION OF THE INVENTION

The reciprocating arm levers of this invention can be attached to any conventional exercise bicycle.

Figure 1:
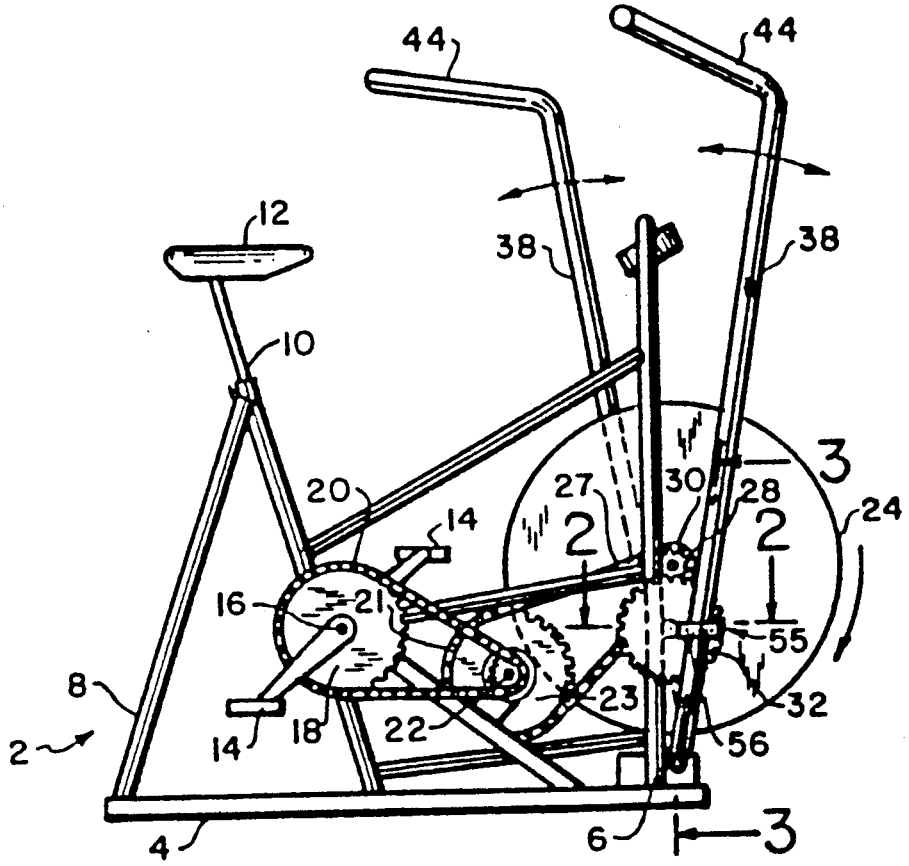
FIG. 1 is a right-side, elevational view of the invention.

The typical exercise bicycle would include a frame 2, comprising a base 4, a front support 6, a rear support 8, a seat support 10 and the seat itself 12. An example of one typical type of exercise bicycle is disclosed in Hooper (U.S. Pat. No. 4,188,030). The frame may be made of tubes, as shown in FIG. 1, or it may be made of plates or other structures which will provide a solid support for the exercise bicycle. Preferably the frame will be made of metal, but some plastics or alloy materials may also prove to be suitable. Any conventional bicycle seat or exercise bicycle seat may be used on the exercise bicycle.

The exercise bicycle also includes right and left foot pedals 14, which are mounted in the usual fashion. Rotation of the foot pedals 14 by the user of the exercise bicycle causes rotation of the main drive shaft 16 and the primary sprocket 18. A chain 20 is passed over the sprocket 18 at one end and on the other end it is connected to a secondary sprocket 22. The secondary sprocket 22 is mounted on an axle 21 which is supported in the frame of the exerciser. Also positioned on the same axle 21 is a second primary sprocket 23. Both the secondary sprocket 22 and the second primary sprocket 23 are designed for rotation with the axle 21. Therefore, as the foot pedals are rotated, by means of the primary sprocket 18, the chain 20 and the secondary sprocket 22, the axle 21 and, necessarily, the second primary sprocket 23 are rotated. A second secondary sprocket 25 is attached to the front-energy absorbing wheel 24 and a second chain 27 connects the second primary sprocket 23 and the second secondary sprocket 25. Thus, pedalling by the user of the exercise bicycle will cause rotation of the primary sprocket 18 and, consequently, the chain drives 20 and 27 and the sprockets 22, 23 and 25, which causes rotation of the flywheel 24. Any of the conventional other systems that are currently in use for exercise bicycles may also be used to link the pedals to the front wheel 24. In some situations, it may be desirable to use only one chain drive and to connect the first secondary sprocket directly to the front wheel. In most instances, it will be desirable to place chainguards over the chains in order to prevent the user of the exercise bicycle from getting dirty or getting his clothes or body caught in the chains.

Figure 5:
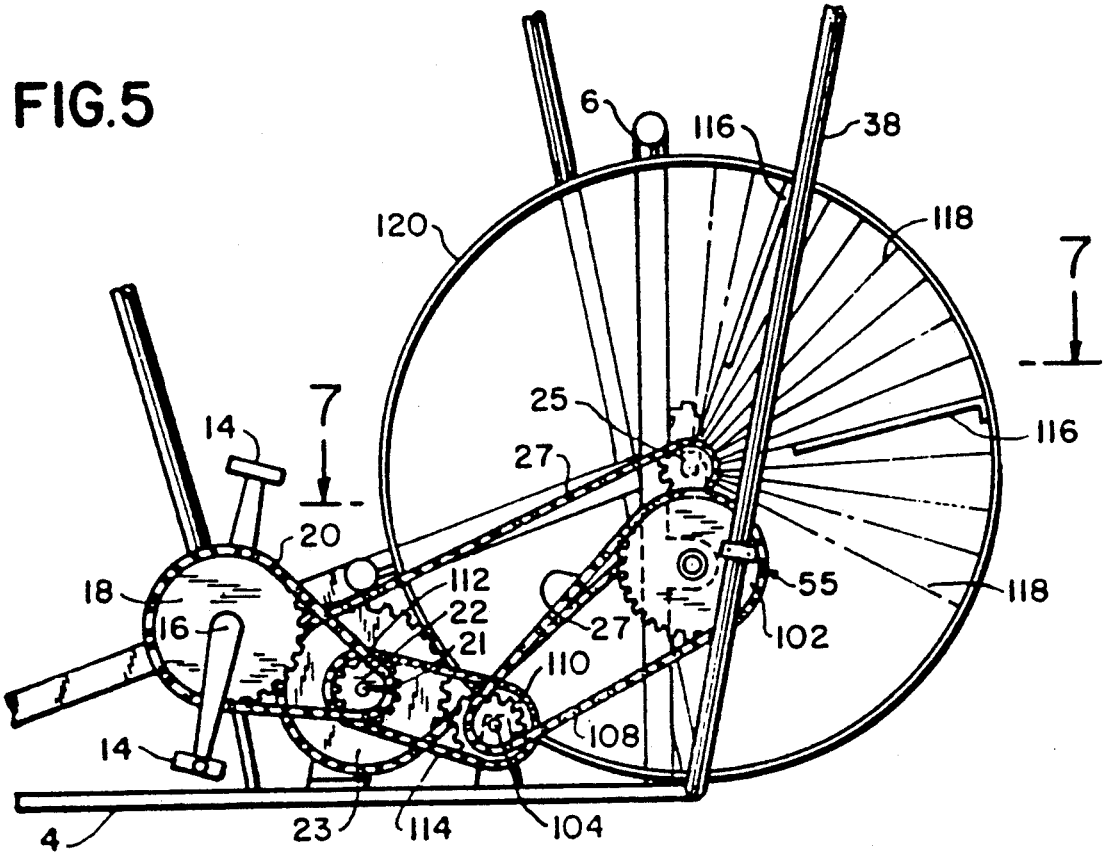
FIG. 5 is a right-side, elevational view of an alternate embodiment of the invention.
Figure 6:
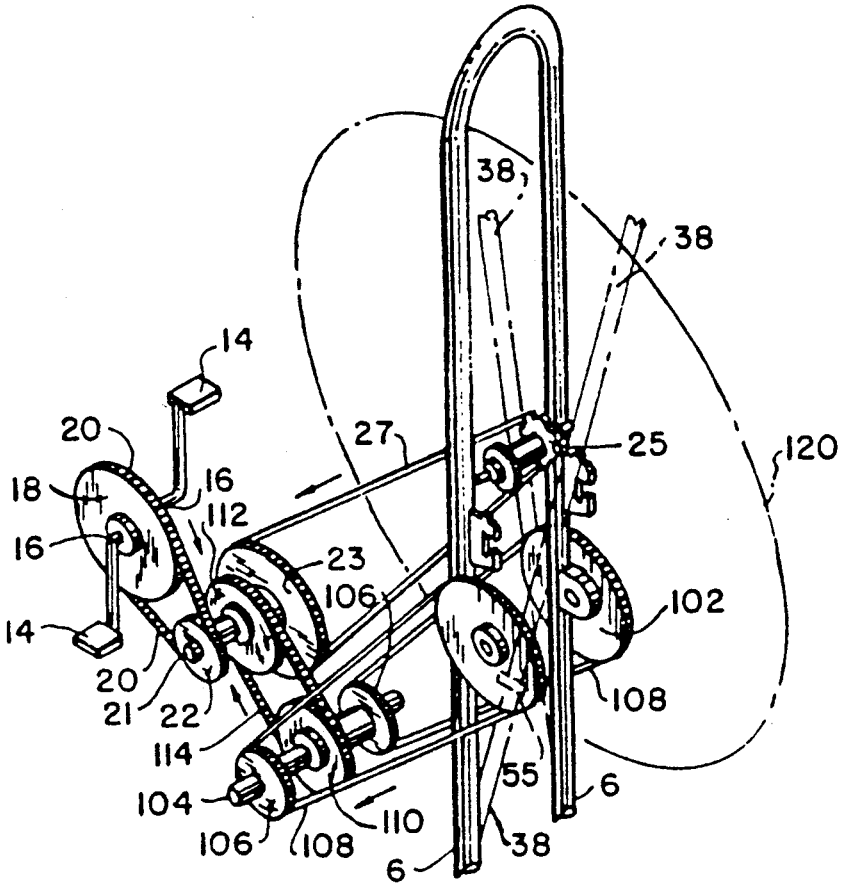
FIG. 6 is an enlarged perspective view showing the alternate arrangement of the invention shown in FIG. 5.
Figure 7:
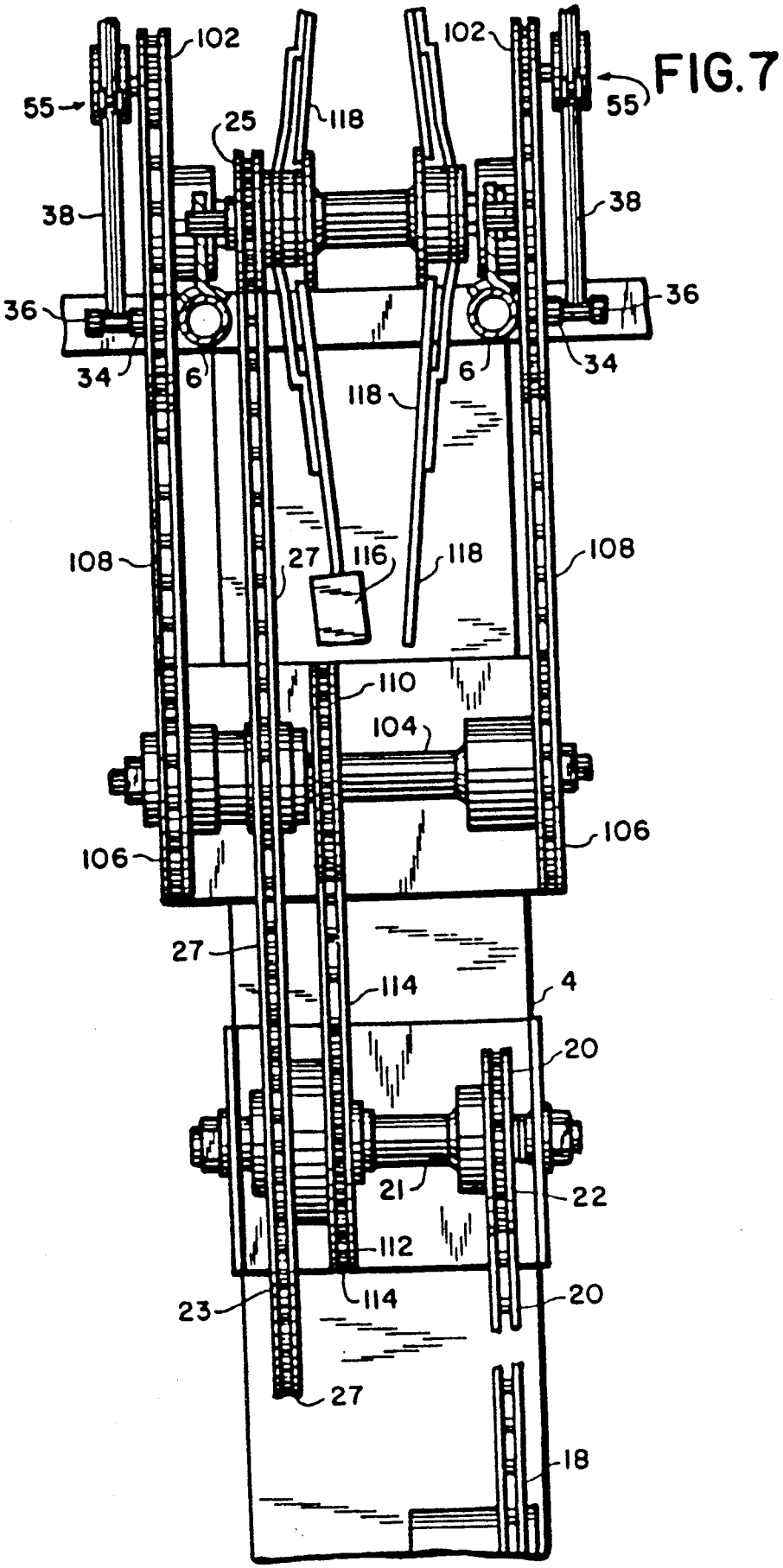
FIG. 7 is a cross-sectional view taken substantially along line 7—7 of FIG. 5.

The front energy absorbing wheel 24 may be of any conventional type that are typically used on exercise bicycles. It may be a solid dink, as shown in FIG. 1, or it may be of a cage-like structure, as shown in Hooper. In addition, it may be desirable to use a front-energy absorbing wheel 24 that is in the configuration of an air-resistance or air-displacement wheel with blades or vanes 116 positioned on the spokes 118 of the front wheel 120, as shown in FIGS. 5–7.

If desired, a speedometer and/or odometer may be connected to the front wheel in order to provide appropriate read-outs to the user. Any other electronic devices, such as clocks or stopwatches, etc. may also be attached, as is commonly known.

Extending outward from the front support 6 is a support rod 34. The lower ends 36 of reciprocating arm levers 38 are mounted for rotation about the support rod 34. One way to do this is to provide an opening 40 in the lower end 36 of the arm levers and to place a bushing (not shown) in the opening and insert the lower end 36 onto the support rod 34. This structure would permit the arm lever 38 to rotate or pivot about the support rod 34. Any other method of connecting the arm lever 38 to the support rod 34 may also be used, provided that it permits rotation or pivoting of the arm lever in the manner hereinafter described. If desired, a footrest can be placed on the support rod 34, outside of the lower end 36 of the arm lever 38. The arm levers 38 are generally made up of round tubing, and the upper end 44 is bent so as to define a handle portion. In the preferred embodiments, a handgrip may be placed on the distal ends of the handle portion 44.

In the embodiment shown in FIGS. 1–4, the front wheel 24 rotates about an axle 26 whose distal ends 28 extend out of the right and left side of the front wheel 24. On each of the ends 28 of the axle a small pinion gear 30 is mounted. The axle 26 is designed to rotate with the front wheel 24, so that the pinion gear 30 will also rotate as the front wheel 24 rotates.

The front support of the bicycle includes two upright vertical supports 6, one on each side of the flywheel 24. Journaled in the front supports 6 are axles 33. Mounted on these axles 33 are large gears 32 which are positioned so as to be in mesh with the respective pinion gears 30. As the front wheel 24 rotates and causes rotation of the pinion gear 30, the large gear 32 will necessarily rotate.

Figure 2:
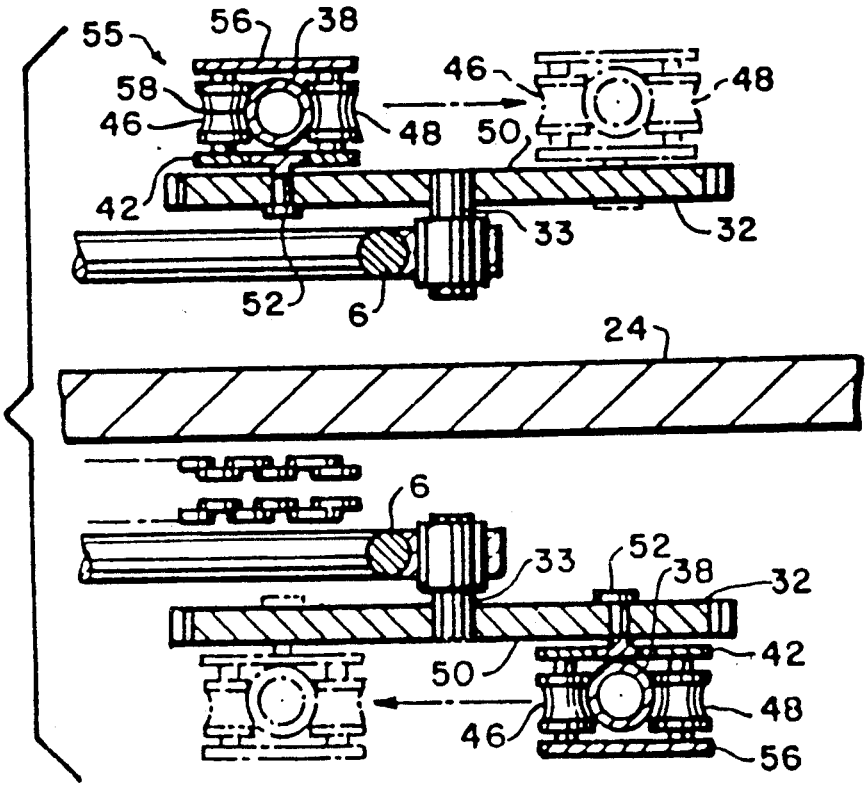
FIG. 2 is a cross-sectional view taken substantially along line 2—2 of FIG. 1.
Figure 3:
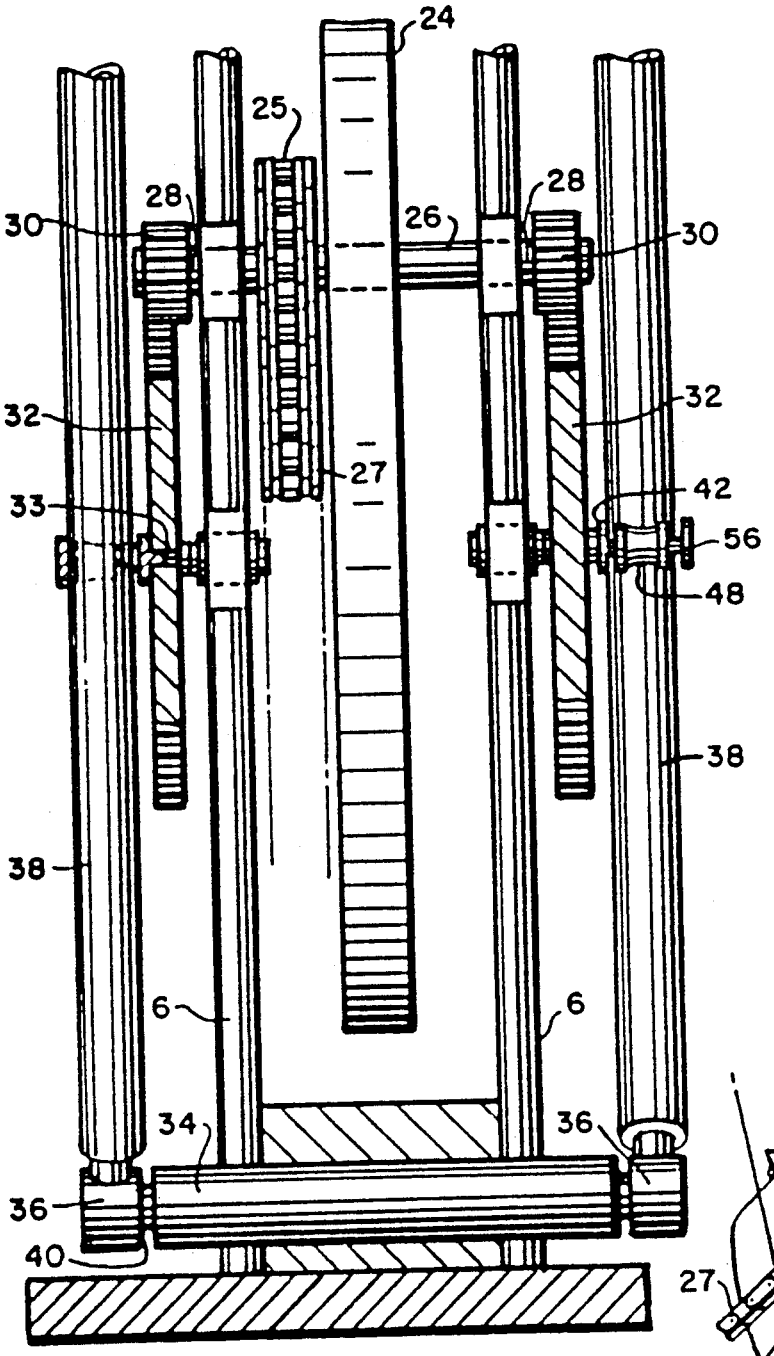
FIG. 3 is a cross-sectional view taken substantially along line 3—3 of FIG. 1

A pin or bolt 52 passes through the large gear 32 and secures a bottom plate 42 to the outer surface 50 of the large gear 32. As shown in FIG. 2, it may be desirable to make the pin or bolt 52 integral with the bottom plate 42. Spindles 54 are used to attach a top plate 56 securely to the bottom plate 42, and rollers 46 and 48 are positioned for rotation on the said spindles 54. The entire structure that is made up by the pin 52, the plates 42 and 56, the spindles 54 and the rollers 46 and 48 serve to define an eccentric 55 which is used to connect the reciprocating arms 38 to the gear train 30 and 32. The pin or bolt 52 is mounted for rotation or rocking within the large gear 32, so that the eccentric 55, as a whole, is permitted some degree of rotation about the outer surface 50 of the large gear 32, as will be hereinafter described.

The arm levers 38 are positioned so that they pass between the plates 42 and 56 of the eccentric and bear against the rounded surfaces 58 of the rollers 46 and 48.

In order to use the exercise bicycle of this invention, the exerciser would sit on the exercise bicycle in a conventional fashion. He could use the foot pedals in the conventional manner and not use the reciprocating arm levers of this invention. Alternatively, he could use both the foot pedals and the reciprocating arm levers or just the arm levers without the foot pedals. Thus, this invention would provide three modes of exercise. In one mode only the lower body would be exercised, in another mode only the upper body would be exercised, and in the third mode both upper and lower portions of the body could be exercised.

Figure 4:
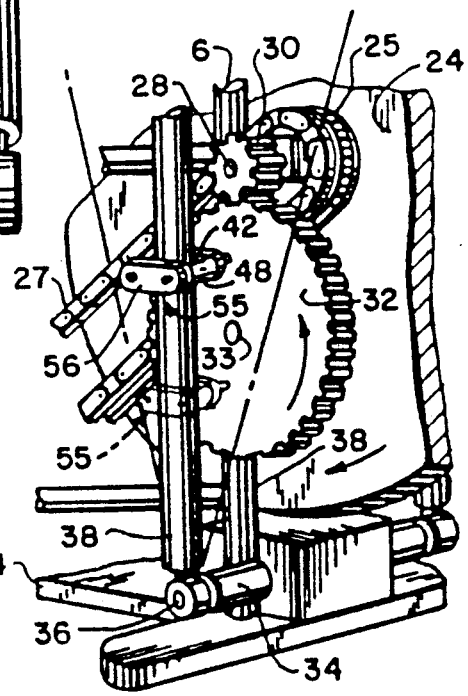
FIG. 4 is an enlarged perspective view showing the first and second gears and the eccentric of the invention.

In operation, the exerciser would reciprocate or move the arm levers 38 forwards and backwards. At one extreme point, the right arm lever would be forward and the left arm lever would be back, and at the other extreme point the positions would be reversed. As the arm levers are moved back and forth, they pivot or rotate about the support rod 34. Because the arm levers 38 are held captive in the eccentric structure 55, this reciprocating or back and forth motion of the arm lever will necessarily cause rotation of the gear 32. Because the eccentric is free to float with respect to the surface 50 of the gear 32, the rollers 46 and 48 will maintain their respective positions and will securely hold the arm levers 38. As shown in FIG. 4, as the gear 32 rotates, the eccentric 55 rotates with it. Because the bolt 52 permits the eccentric's structure to slightly rotate or rock, the eccentric is able to maintain its position as the gear 32 rotates. In FIGS. 2 and 4, the eccentric is shown in phantom in different positions on the rotating gear 32.

This rotation of the gear 32 necessarily causes rotation of the pinion gear 30. As the pinion gear 30 is secured to the axle 26, rotation of the pinion gear causes rotation of the axle 26 and the front wheel 24.

In one embodiment of the invention, the ratio of the pinion gear 30 to the gear 32 is 1:9, but this can be changed or modified in order to make it easier or more difficult to reciprocate the arm levers.

In an alternate embodiment of the invention, it is possible for the pinion gear 30 to be eliminated and to simply use the large gear 32 which is secured to the axle 26. Such an arrangement would also come within the scope of the invention and would work.

In some embodiments, it may be desirable to provide an element to disengage the pedals when the exerciser is using only the arm levers 38, and not the foot pedals 14. Thus, the pedals will not rotate when only the arm levers are being used, and this will prevent the needless banging of the foot pedal against the lower legs of the exerciser. For this purpose, a one-way clutch 21 may be provided. In this way, the secondary sprocket 22 will engage the second primary sprocket 23 only when the pedals are being rotated by the feet of the exerciser, but it will not engage when the pedals are not rotated and only the front wheel 24 is being turned. In other words, when the exerciser is using the foot pedals 14, the one-way clutch 21 will engage, and the secondary sprocket 22 will cause rotation of the second primary sprocket 23; and, when the foot pedals are not used and the front wheel 24 is rotating by means of reciprocation of the arm levers 38, the one-way clutch will cause disengagement of the second primary sprocket and the second sprocket 22, thereby preventing rotation of the foot pedals 14. This one-way clutch is shown in FIG. 1, but it can be appreciated that it can be either included or not included at the option of the person making the invention. In some situations it may be advisable to include the one-way clutch between the second secondary sprocket 25 and the flywheel 24, instead of between the secondary sprocket 22 and the second primary sprocket 23.

In the alternate embodiment shown in FIGS. 5-7 a chain and sprocket wheel system is used to connect the eccentric to the front wheel 120, as opposed to the gear system shown in FIGS. 1-4. In this embodiment, the eccentric 55 would be positioned on the surface of a sprocket wheel 102 instead of on the large gear 32. The interconnection between the reciprocating arms 38 and the eccentric 55 would be in the same manner as it is in the embodiment shown in FIGS. 1-4. This part of the invention is the same in both embodiments. In both cases, the eccentric is mounted on a gear or sprocket wheel which is caused to rotate by the back and forth movement of the reciprocating arms 38.

Positioned on the frame of the exerciser is a shaft 104 with two sprocket wheels 106 disposed on either end. Chains 108 are used to connect the sprocket wheels 102 with respective sprocket wheels 106. As the eccentric and reciprocating arms cause rotation of the sprocket wheels 102, the chain 108 necessarily causes rotation of the sprocket wheels 106 and the shaft 104. Positioned on the shaft 104, and preferably between the sprocket wheels 106, is another sprocket wheel 110.

On the shaft 21 on which the secondary sprocket 22 and the second primary sprocket 23 are positioned, an additional sprocket wheel 112 is located. A chain 114 connects the sprockets 110 and 112. As the shaft 104 rotates, the sprocket 110 is also rotated. This causes rotation of the chain 114, the sprocket 112 and, necessarily, the shaft 21. As the shaft 21 rotates, it causes rotation of the sprocket 23 and the chain 27. This, in turn, causes rotation of the sprocket wheel 25 located on the front wheel 120.

As can be seen, the system comprising the chains 108, 114 and 27 and the sprocket wheels 106, 110, 112, 23 and 25 cause rotation of the front wheel 120 when the eccentric and the reciprocating arms cause rotation of the sprocket wheel 102.

In both embodiments, the reciprocating arms are interconnected with an eccentric which causes rotation of a wheel when the arms are moved back and forth. In each case the wheel on which the eccentric is positioned is connected by a drive means to the front wheel, and this drive means is separate from the drive means that is used to connect the foot pedals to the front wheel.

I claim:

1. An exercise bicycle having a frame, a seat positioned on said frame, foot pedals means, an energy-absorbing wheel and first linkage means for linking the foot pedal means to the energy-absorbing wheel, wherein the improvement comprises:

wheel means rotatably mounted on said frame said wheel means associated with said first linkage means;

lever means pivotally mounted on said frame and interacting with said wheel means for rotation of said wheel means upon reciprocation of said lever means; and second linkage means for linking said wheel means to the energy-absorbing wheel, whereby said first or second linkage means may independently operate said energy-absorbing wheel such that movement of said first and second linkage means may be independent from one another, said second linkage means for linking said wheel means to the energy absorbing wheel includes a first gear positioned on an axle of said energy-absorbing wheel, a second gear in mesh with said first gear and mounted on said frame, and an eccentric means being positioned on said second gear.

2. An exercise bicycle according to claim 1 wherein said wheel means includes a gear means for rotation with said energy-absorbing wheel, said gear means affixed to an axle of said energy-absorbing wheel.

3. An exercise bicycle according to claim 1 further comprising a means for disengaging the pedal means from the energy-absorbing wheel when the lever means is causing rotation of said energy-absorbing wheel.

4. An exercise bicycle having a frame, a seat positioned on said frame, foot pedal means, an energy-absorbing wheel and first means for linking the foot pedal means to the energy-absorbing wheel, wherein the improvement comprises:

rotation means mounted for rotation about an axis on said frame said rotation means associated with said first linkage means;

reciprocating means pivotally mounted for reciprocation on said frame and interacting with said rotating means for rotation of said rotating means upon reciprocation of said reciprocating means; and second means for linking said rotating means to the energy-absorbing wheel, whereby said first or second linking means may independently operate said energy-absorbing wheel such that movement of said first and second linkage means may be independent from one another, said second means for linking said means for rotating to the energy absorbing wheel includes a first gear positioned on an axle of said energy-absorbing wheel; and a second gear in mesh with said first gear and mounted on said frame, and an eccentric means being positioned on said second gear.

5. An exercise bicycle according to claim 4 wherein said means for rotating includes gear means affixed to an axle of said energy-absorbing wheel for rotation with said energy-absorbing wheel.

6. An exercise bicycle according to claim 4 further comprising a means for disengaging the pedal means from the energy-absorbing wheel when the reciprocating means is causing rotation of said energy-absorbing wheel.

* * * * *